US009877605B2

(12) United States Patent
Clark

(10) Patent No.: US 9,877,605 B2
(45) Date of Patent: Jan. 30, 2018

(54) REUSABLE MUG COVERS AND METHODS RELATED THERETO

(75) Inventor: Denise L. Clark, Ames, IA (US)

(73) Assignee: FLOUNDER LLC, Ames, IA (US)

( * ) Notice: Subject to any disclaimer, the term of this patent is extended or adjusted under 35 U.S.C. 154(b) by 1521 days.

(21) Appl. No.: 12/392,010

(22) Filed: Feb. 24, 2009

(65) Prior Publication Data

US 2010/0301061 A1 Dec. 2, 2010

Related U.S. Application Data

(60) Provisional application No. 61/031,514, filed on Feb. 26, 2008.

(51) Int. Cl.
*A47G 19/22* (2006.01)
*A47G 19/20* (2006.01)

(52) U.S. Cl.
CPC ..... *A47G 19/2288* (2013.01)

(58) Field of Classification Search
CPC ..... A47G 19/2288
USPC .... 220/703, 739, 740, 737; D7/624.2, 624.3
See application file for complete search history.

(56) References Cited

U.S. PATENT DOCUMENTS

| | | | | |
|---|---|---|---|---|
| 370,600 | A | 9/1887 | Bonser | |
| 2,035,384 | A * | 3/1936 | Hinchliff | 66/170 |
| 2,474,375 | A | 6/1949 | Shearer et al. | |
| 2,522,381 | A * | 9/1950 | Kramer | 215/12.1 |
| 4,197,890 | A * | 4/1980 | Simko | 383/97 |
| 4,462,444 | A | 7/1984 | Larson | |
| 4,514,995 | A | 5/1985 | Curtis | |
| 4,540,611 | A * | 9/1985 | Henderson | 428/12 |
| D302,636 | S * | 8/1989 | Singer | D7/607 |
| 4,871,597 | A * | 10/1989 | Hobson | 428/36.1 |
| 5,198,288 | A | 3/1993 | Grunfeld | |
| 5,205,473 | A | 4/1993 | Coffin, Sr. | |
| 5,344,040 | A | 9/1994 | Schaeppi | |
| 5,415,305 | A * | 5/1995 | Drake-Tipton et al. | 215/392 |
| 5,425,497 | A | 6/1995 | Sorensen | |
| D370,600 | S * | 6/1996 | Downes | D7/607 |
| 5,590,808 | A | 1/1997 | Schaeppi | |
| 5,863,664 | A | 1/1999 | McCormick et al. | |
| 5,868,310 | A | 2/1999 | Leszczynski | |
| D423,299 | S * | 4/2000 | Burrus | D7/607 |
| 6,863,664 | B2 | 3/2005 | Wada et al. | |
| 6,986,438 | B2 | 1/2006 | Leung | |
| 7,111,753 | B2 | 9/2006 | Scheetz, II et al. | |
| 7,152,750 | B2 * | 12/2006 | Coffey | 215/11.6 |

(Continued)

FOREIGN PATENT DOCUMENTS

| | | |
|---|---|---|
| GB | 2382049 | 3/2003 |
| HK | 1055927 | 8/2005 |

*Primary Examiner* — J. Gregory Pickett
*Assistant Examiner* — Niki M Eloshway
(74) *Attorney, Agent, or Firm* — Clark IP Law, PLC

(57) ABSTRACT

A mug cover comprising one or more layers of reusable cloth adapted to conform to a mug having a bottom, wherein the one or more layers of reusable cloth covers at least a portion of the bottom of the mug is disclosed. In one embodiment, the reusable cloth has an opening (e.g., slit or cutout) through which a mug handle may extend. The portion covering the bottom serves as a coaster. Methods of making and providing reusable mug covers are also disclosed. In one embodiment, one or more mug covers are sold in kits, together with dried food products and/or other articles.

8 Claims, 7 Drawing Sheets

(56) References Cited

U.S. PATENT DOCUMENTS

| | | | | |
|---|---|---|---|---|
| D536,936 | S | 2/2007 | Tiemann | |
| 7,185,784 | B2 | 3/2007 | Connors, Jr. et al. | |
| 7,191,914 | B2 | 3/2007 | McCaslin | |
| D544,312 | S * | 6/2007 | Dill-Schmidt et al. | D7/624.3 |
| D605,900 | S * | 12/2009 | Bodum | D7/607 |
| 2003/0019155 | A1* | 1/2003 | Alcazar et al. | 47/72 |
| 2003/0075549 | A1* | 4/2003 | O'Brien et al. | 220/739 |
| 2007/0125787 | A1* | 6/2007 | Oathout et al. | 220/592.16 |
| 2008/0093370 | A1 | 4/2008 | Darsey | |
| 2008/0285621 | A1* | 11/2008 | Rowen | 374/150 |

* cited by examiner

REUSABLE MUG COVERS AND METHODS RELATED THERETO

This application claims the benefit under 35 U.S.C. 119 (e) of U.S. Provisional Application No. 61/031,514 filed on Feb. 26, 2008, which is hereby incorporated by reference in its entirety.

BACKGROUND

Various types of hot and cold food products are enjoyed daily by consumers worldwide. Such food products are contained in a variety of containers. Hot beverages, for example, are typically contained in mugs.

SUMMARY

The inventor is the first to recognize a significant need in the art for a safe, convenient and reusable food product container cover. In one embodiment, a mug cover comprising one or more layers of a reusable cloth adapted to conform to a mug having a bottom, wherein the one or more layers of reusable cloth covers at least a portion of the bottom of the mug, is disclosed. In one embodiment, the reusable cloth has an opening (e.g., slit or cutout) through which a mug handle may extend.

In one embodiment, the reusable cloth has an elastic elongation of about ten (10) to about 70%. In one embodiment, the reusable cloth is made from fibers selected from cotton, wool, nylon, polyester, spandex and combinations thereof. In a particular embodiment, the reusable cloth contains about one (1) wt % to about five (5) wt % spandex.

The reusable mug cover may further comprise additional or separate components, such as one or more conforming components. Examples of conforming components include, but are not limited to, an elasticized material (e.g., "elastic" of various widths of the type commonly used in sewing) or ties (e.g., ribbon, string, yarn, and combinations thereof). Conforming components may further include one or more of any type of zipper, hook, hook and loop fastener, snap, button, and combinations thereof. In some embodiments, the conforming component also functions as a closing component.

The reusable mug cover may further include a coaster portion which covers varying amounts of the bottom of a mug, from ten (10) % to 50% up to 90% or essentially the entire bottom of the mug.

The reusable mug covers described herein may further have any type of design or image or a plurality of designs and/or images. Such designs and/or images may be selected from regular shapes, irregular shapes, letters, numbers, photographs or drawings of living or non-living objects, including people (e.g., faces), animals, and the like, and combinations thereof.

Embodiments further include a method comprising providing a length of reusable cloth; and cutting or shaping the reusable cloth to form a reusable food product container cover, such as a mug cover, for use on a mug having a bottom, the reusable mug cover capable of covering at least a portion of the bottom of the mug. The method may further comprise cutting an opening (e.g., slit or cutout) in the reusable cloth. The method may further comprise adding a conforming component, a closing component, or a combination thereof, to the reusable food product container cover. In one embodiment, the method further comprises first shaping a plurality of fibers into a desired shape for use as a reusable food product container cover.

Embodiments further include a method comprising providing a reusable mug cover for use on a mug having a bottom, the reusable mug cover capable of covering at least a portion of the bottom of the mug; and reducing a rate of temperature change of beverage contained in the mug. In one embodiment, the method further comprises distributing the reusable mug cover to a consumer.

In one embodiment, a kit which includes one or more mugs, each of the one or more mugs having a bottom; one or more reusable mug covers sized to conform to the one or more mugs, wherein each of the one or more reusable mug covers are designed to cover at least a portion of the bottom of each of the one or more mugs; and dried food products, such as cocoas, teas, coffees, soups, and combinations thereof, is disclosed. In one embodiment, the kit further comprises solid food products, semi-solid food products, liquid food products (including concentrates), or combinations thereof, various dining paraphernalia and/or various reading materials and/or related articles.

In one embodiment, the reusable mug covers described herein serve as thermal insulators by reducing the rate of heat transfer to and from the food products contained within the container it surrounds. As such, the reusable mug covers are able to keep high temperature foods warmer and cold temperature foods colder longer. The reusable mug covers described herein may be removed from the container, washed and reused any number of times. In one embodiment, the reusable mug covers are microwaveable.

In one embodiment, the reusable mug covers provide a substantially rough, easy-to-grip surface, particularly as compared with smooth-surfaced containers having no cover. By providing a protective covering around the container, the reusable mug covers described herein also reduce the risk of container breakage if the container is dropped. Additionally, by reducing the possibility of a user inadvertently touching a hot and/or slippery container surface, the likelihood of the container being dropped by a user is also reduced. As a result, the possibility of spillage and its inherent risks to person and property, particularly with hot food products, is reduced. This feature is an advantage over containers having no cover or utilizing a make-shift holder for a container, such as a separate cloth or hot pad. Furthermore, in contrast to paper wraps used by fast food establishments, the reusable mug covers described herein are reusable, thus reducing environmental waste. The reusable mug covers are also customizable, and in some embodiments, further serve as a coaster.

DETAILED DESCRIPTION

Figure 1:
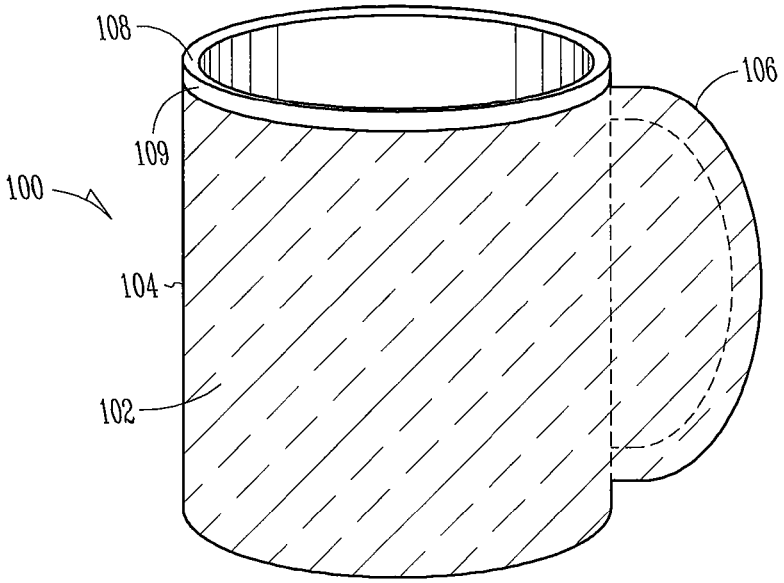
FIG. 1 is a simplified front view of a mug with a reusable mug cover in place in an exemplary embodiment.

In the following detailed description of the embodiments, reference is made to the accompanying drawings that form a part hereof, and in which is shown by way of illustration, specific preferred embodiments in which the subject matter may be practiced. These embodiments are described in sufficient detail to enable those skilled in the art to practice them, and it is to be understood that other embodiments may be utilized and that mechanical, structural, and procedural changes may be made without departing from the spirit and scope of the present subject matter. The following detailed description is, therefore, not to be taken in a limiting sense, and the scope of embodiments is defined only by the appended claims, along with the full scope of equivalents to which such claims are entitled.

Definitions

As used herein, the term "cloth" or "fabric" refers to any type of reusable and washable textile (i.e., flexible material) made in any manner known in the art, including, but not limited to, weaving, felting, knitting, crocheting, knotting, and the like. The textile may be made of a network of natural fibers, synthetic or artificial fibers, or any combination thereof As used herein, the term "type" such as when referring to "different types of fibers" refers to fibers having "a substantially different overall material composition" with measurably different properties, outside of "average diameter" or other "size" differences. That is, two fibers may be of the same "type" as defined herein, yet have different "average diameters" or "average diameter ranges." Although fibers are of different "types" when they have a substantially different overall material composition, they may still have one or more materials in common. The "substantially different overall material composition" may be characterized in that at least one material comprising a first weight percent of at least one (1) weight percent in a first fiber type (based on measurement of a representative sample size) has a substantially different second weight percent in a second fiber type. Fibers of different "types" may also have a completely different content, such as polyester and spandex or nylon and spandex.

The term "nylon" as used herein is a generic name for any long chain synthetic polymeric amide, which has recurring amide groups as an integral part of the main polymer chain. Examples include, but are not limited to, nylon-6, nylon-11, nylon-12, nylon-13 and nylon 6-6.

The term "spandex" as used herein is a generic name for a manufactured elastomeric fiber in which the fiber forming substance is a long chain of synthetic polymer made of at least 85% of a segmented polyurethane (Federal Trade Commission (FTC) definition). Spandex (or elastane) is lightweight, durable, soft, static resistant and may be repeatedly stretched over 500% without breaking, and will still recover to its original length. Spandex is easily dyed and also presents no static or pilling problem. Spandex is known to be resistant to oils, perspiration, detergents, lotions, and so forth.

Description of the Embodiments

In one embodiment, a reusable mug cover is disclosed. In the embodiment shown in FIG. 1, the reusable mug cover 100 is comprised of a reusable cloth 102 designed to surround an outer surface of a mug 104 having a handle 106 and a lip 108. In one embodiment, the reusable mug cover 100 is comprised of a single layer of reusable cloth 102. In other embodiments, the reusable mug cover 100 is comprised of two or more layers of reusable cloth 102. In this embodiment, the reusable mug cover 100 also surrounds the handle 106 as shown. Such a configuration allows a user to place one or both hands entirely on the reusable mug cover 100 itself.

In the exemplary embodiment shown in FIG. 1, the reusable mug cover 100 is capable of thermally insulating the mug 104, to slow the rate of temperature change of contents contained therein. In one embodiment, the reusable mug cover 100 is elasticized to conform to a variety of mug shapes, including the shape of the mug 104 and handle 106 shown in FIG. 1. In such embodiments, the reusable mug cover 100 has sufficient elasticity so that it is not loose or baggy around the mug 104, i.e., may continuously conform to the mug 104 and snap back to substantially conform again after being stretched. In a particular embodiment, the reusable mug cover 100 has an elastic elongation of about ten (10) to about 70%, although the invention is not so limited.

In some embodiments, the reusable mug cover 100 may conform to any shape due, at least in part, to the manner in which the reusable cloth 102 is cut. For example, in one embodiment, the reusable mug cover 100 is cut along the bias (along the 45 degree diagonal) to provide additional stretch and/or is made from a reusable cloth 102 having less inherent stretch than a knit or spandex fabric. In such embodiments, the reusable mug cover 100 may be made from a non-elasticized or minimally elasticized reusable cloth 102.

In some embodiments, one or more "separate" conforming components are additionally or alternatively used to enhance the ability of the reusable cloth 102 to conform to the shape of a given mug 104. Such separate conforming components may be used to draw the fabric together around the mug 104 in any suitable location, such as around the handle 106, lip 108, sides and/or underneath the mug 104. The separate conforming components may include a pulling component, such as a tie or lengths of elastic threaded through a casing, and so forth. Such ties may be used as draw strings, and may include, but are not limited to, strings (including shoe string-type strings), ribbons, yarns, threads, and the like. Ties may further be elasticized to provide additional pull. See, for example, FIG. 4C, discussed below, which shows a tie 450 in use as a draw string-type conforming component around the bottom surface of the mug 104.

In other embodiments, the separate conforming component may include one or more closing components selected from one or more of a zipper, snap, hook, button, any of various loop and hook-type connectors and fasteners, such as Velcro® brand fasteners (Velcro USA Inc., Manchester, N.H.), and the like, further including any combination thereof. The one or more closing components are preferably designed to not interfere with the container's ability to remain in a stable upright position, if desired, when not being held by the user. In one embodiment, the one or more closing components are placed along edges of the reusable mug cover 100 which are located along the vertical surface of the mug 104 when in use. (See, for example, FIG. 7, in which the one or more conforming components also serve as a closing component).

The reusable mug cover 100 may have any suitable size and shape. In one embodiment, the reusable mug cover 100 is made at least partially from a reusable cloth 102 capable of stretching in either the crosswise or lengthwise direction in order to accommodate a variety of mug circumferences without the need for separate conforming means. (Such fabrics are commonly referred to as "two-way" stretch fabrics, but may also be referred to as a "one-way" stretch fabric). In one embodiment, the reusable cloth 102 is a material capable of stretching in both the crosswise and lengthwise direction. One example of such a material is spandex (e.g., Lycra®, Invista, Wichita, Kans.). (Such fabrics are commonly referred to as "four-way" stretch fabrics, as compared to a "two-way" stretch fabric, above, but may also be referred to as a "two-way" stretch fabric, as compared to a "one-way" stretch fabric, above).

In one embodiment, the reusable mug cover 100 is made from a reusable cloth 102 which stretches at least 75% in one or more directions. In one embodiment, the reusable cloth 102 stretches crosswise from an initial width of about two (2) to about five (5) inches to a final width of about five (5) to about 12 inches. In such an embodiment, the reusable cloth 102 may further have a length of about four (4) to about eight (8) inches. In other embodiments, the reusable cloth 102 may additionally or alternatively stretch lengthwise from an initial length of from four (4) to about eight (8) inches to a final length of about five (5) to about 10 (ten) inches. In one embodiment, the reusable mug cover 100 has a minimum thickness of about 0.2 inches. In one embodiment, the reusable mug cover 100 has a tube shape comparable in diameter to the ankle portion of a stretchable adult sock.

Any suitable type of reusable cloth 102 containing a variety of different types of fibers may be used for the reusable mug cover 100. Fabric content determines elasticity, durability, softness, weight and so forth. In one embodiment, the reusable mug cover 100 contains spandex. Spandex is a highly elastic fiber that allows the reusable cloth 102 to continuously conform to the mug 104. Use of spandex further adds softness, abrasion resistance, and durability to the reusable mug cover 100. Generally, the amount of spandex content will be limited by the power, modulus strength and elongation of the spandex fibers, as well as by the constrictive power desired. If the constrictive power is too high, it may more difficult to place the reusable mug cover 100 on the mug 104 and/or remove it. If the constrictive power is too low, additional conforming components may be useful to keep the reusable mug cover 100 in place during use.

In one embodiment, the reusable cloth 102 contains about (2) weight (wt) % spandex up to about ten (10) wt % spandex. In one embodiment, the reusable mug cover 100 contains up to about five (5) wt %, such as at least about one (1) wt % up to about five (5) wt % of spandex, although the invention is not so limited. In other embodiments, the reusable cloth 102 contains any suitable amount of spandex to provide the desired features, including conforming properties, such as about 0.1 wt % up to about one (1) wt %, or more than one (1) wt % up to about three (3) wt % spandex. In one embodiment, the reusable cloth 102 contains about 1.5 wt % to about 2.5 wt % spandex or about 0.5 wt % to about two (2) wt % spandex. In one embodiment, the reusable cloth 102 contains about two (2) wt % spandex. In other embodiments, higher amounts of spandex may be used, such as up to ten (10) wt %. In one embodiment, the reusable cloth 102 contains more than about 10 wt % of spandex, up to about 15 wt % or about 20 wt %. In one embodiment, the reusable cloth 102 contains more than about 20 wt %, up to about 50 wt %, or up to about 75 wt % of spandex fibers.

Alternatively or additionally, as noted above, the reusable cloth 102 may further include one or more alternative types of elasticized fibers other than spandex, capable of providing the desired features, including conforming properties. In yet other embodiments, as noted above, the reusable mug cover 100 may additionally or alternatively further contain separate conforming components.

Other contents of the reusable cloth 102 may include any natural or synthetic fabrics, including, but not limited to, cotton, acrylic, polyester (e.g., silk), nylon, a cotton-polyester blend, and the like, further including Coolmax® (DuPont®, Wilmington, Del.), and/or wool, alpaca, hemp, rayon, mohair, angora and/or ramie, and the like. In one embodiment, the additional components comprise a tightly woven knit fabric or double-knit fabric similar to a jersey fabric. In one embodiment, the reusable cloth 102 is a worsted cloth. In one embodiment, the reusable cloth 102 is a loosely woven knit fabric made of any suitable type of knitting or weaving yarn containing any type of suitable fibers or fiber combinations, such as cotton, wool, alpaca, hemp, rayon, polyester, mohair and/or nylon, and so forth, including any type of elasticized yarn, worsted yarn, and so forth. In other embodiments, the reusable cloth 102 includes components to resist mildewing, rusting, and the like. In one embodiment, the reusable mug cover 100 is made from fabrics and yarns such as those described in U.S. Pat. No. 5,198,288, incorporated herein by reference in its entirety. The reusable mug cover 100 may alternatively or additionally include any suitable type of nanofibers, nanoparticles, and the like.

In one embodiment, the reusable mug cover 100 is adjustable as to location on the mug 104. In this way, the user may adjust the precise location on the mug 104 for his or her comfort. For example, in some embodiments, it may be desirable to push the reusable mug cover 100 away from the lip 108 of the mug 104 to create a gap 109, as shown in FIG. 1. Extra cloth may then be bunched up along the sides of the mug 104, providing more fabric for gripping. Alternatively or additionally, the reusable mug cover 100 may be pulled sufficiently to cover some or all of the bottom of the mug 104, thus providing a coaster. (See, for example, FIGS. 4A, 4B and 4C). In yet other embodiments, a desired amount of the top portion of the reusable mug cover 100 may be folded outwardly or inwardly a desired amount to create the gap 109. In one embodiment, the reusable mug cover 100 is designed to fit a particular size mug such that an appropriate gap 109 is present around the lip of the mug and there is sufficient fabric to also cover some or all of the bottom of the mug, without excess cloth being present.

The exemplary gap 109 shown in FIG. 1 may be particularly desirable in embodiments in which the mug 104 is put directly to a user's lips to consume the contents. In this way, the contents do not come in contact with the reusable mug cover 100 during use and/or the user's lips do not contact the reusable mug cover 100 while drinking from the mug 104. In one embodiment, the gap 109 is at least about 0.3 to about 0.5 inches, or at least about 0.5 inches. In some embodiments, the gap 109 may be greater than about 0.5 inches up to about one (1) or about two (2) inches or more, such that only about 50% of the mug is covered with the reusable mug cover 100. A gap 109 smaller than about 0.3 inches or no gap is also possible. Such a configuration may be desirable in situations in which the contents are intended to be consumed with a utensil such as a spoon or fork and the mug is not being brought to the user's lips. However, even in these embodiments, a gap 109 may be desirable to prevent contact of the contents with the reusable mug cover 100.

The reusable mug cover 100 has the additional advantage of being removable from the mug 104 to be used on a different mug, to be cleaned, etc. In one embodiment, the reusable mug cover 100 is cleanable in any suitable manner, such as by washing (e.g., by hand, washing machine or dishwasher). In one embodiment, the reusable mug cover 100 is microwaveable, allowing the user to place the reusable mug cover 100 on the mug 104 prior to heating the contents of the mug 104.

The reusable mug cover 100 enhances the insulating properties of the mug 104, thus reducing the rate of temperature change of the food and/or liquid contents contained therein (See Example 1). Thus, the contents remain at a desirable temperature for consuming for a longer period of time as compared with having no reusable mug cover 100. For example, it is expected that the rate of temperature loss in a hot beverage will be reduced by about five (5) to 25%, or possibly higher, even up to 30%, depending on the thickness of and fiber types in the reusable cloth 102, size of mug 104, temperature and nature of contents in the mug 104, and so forth. The amount of heat radiating from the mug 104 will further depend on the insulating properties of the material comprising the mug 104, e.g., ceramic, glass or metal, and so forth. In one embodiment, the reusable mug cover 100 further allows sufficient heat to radiate from heated contents contained within the mug 104, to an outer surface of the reusable mug cover 100, thus providing warmth to the user's hands when held. Such warmth may provide a sense of comfort and well-being to the user. Without the reusable mug cover 100 in place, the heat radiating to an outer surface of a mug 104 may be at a level to cause at least discomfort to the user, up to intolerable pain.

Other embodiments are possible which will provide most, if not all, of the advantages described above, as well as additional advantages. For example, in the exemplary embodiment shown in FIG. 2, the reusable mug cover 200 is designed to fit around only the mug 104 and not the handle 106, thus allowing the user to grasp an uncovered handle 106 during use. Such an embodiment allows the user to place fingers through an opening 210 created by the handle 106, such that the handle 106 may be fully grasped. In other embodiments, the reusable mug cover 200 may surround only a portion of the handle 106.

Figure 2:
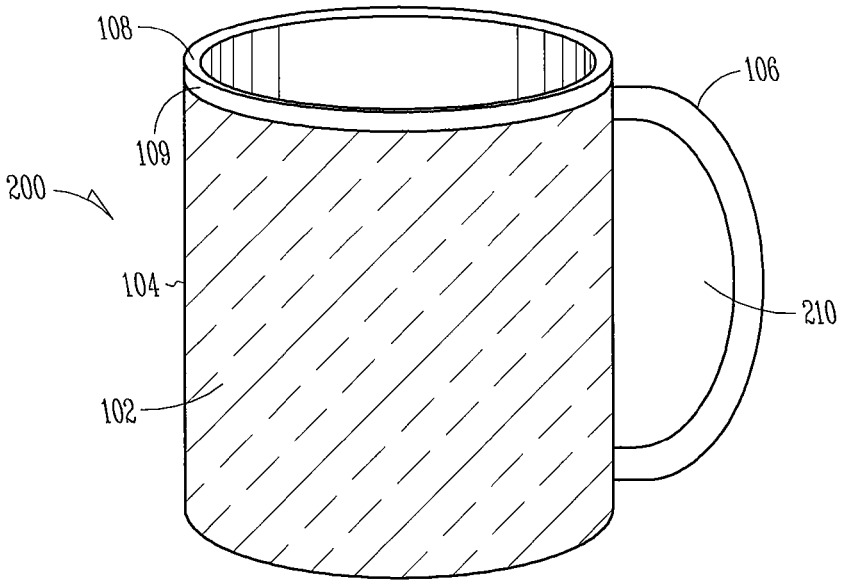
FIG. 2 is a simplified front view of a mug with an alternative reusable mug cover in place in an exemplary embodiment.
Figure 3A:
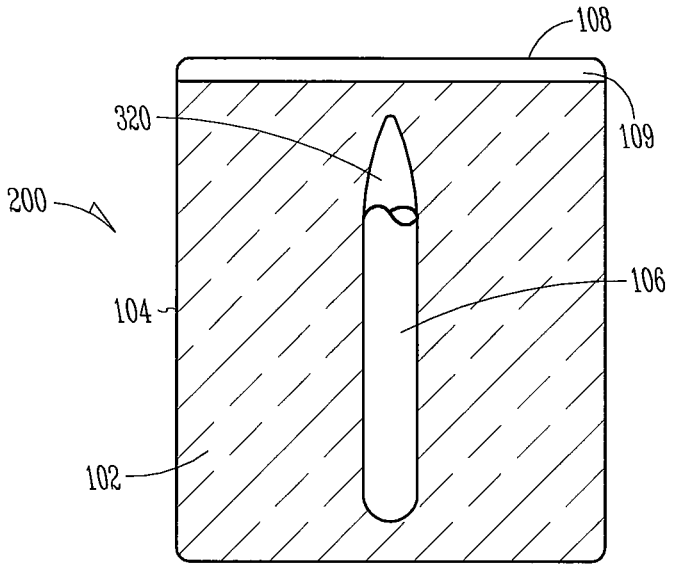
FIG. 3A is a simplified side view of the reusable mug cover in FIG. 2 having a slit in an exemplary embodiment.

FIG. 3A provides a simplified side view of the mug 104 in FIG. 2 with the reusable mug cover 200. In this exemplary embodiment, an expandable slit 320 is present in the reusable mug cover 200 through which a mug handle 106 may protrude. In one embodiment, the expandable slit 320 is oriented substantially perpendicular to edges of the reusable mug cover 200.

Figure 3B:
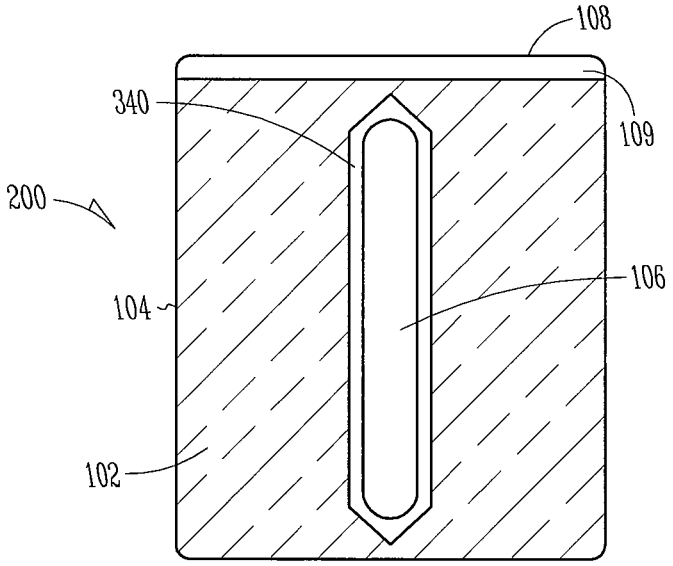
FIG. 3B is a simplified side view of the reusable mug cover in FIG. 2 having a cutout in an exemplary embodiment.

In the exemplary embodiment shown in FIG. 3B, a cutout 340 (instead of the expandable slit 320) is present in the reusable mug cover 200 to create a suitable opening for the handle 106. The cutout 340 may be of any suitable size and shape and may also be expandable, depending on the fiber types used in the reusable cloth 102. In one embodiment, the cutout 340 is a rectangular shape. In one embodiment, the cutout 340 has a width of about 0.25 to one (1) inch and a length of about one (1) inch to about five (5) inches. In the exemplary embodiment shown in FIG. 3B, the cutout 340 has tapered top and bottom edges, thus exposing a portion of the mug 104 along the sides, top and bottom of the handle 106. It is possible that less or more of the mug 104 may be exposed with use of a cutout 340, depending on the size of the cutout opening.

In one embodiment, the reusable mug cover (e.g., 100, 200) further comprises a coaster portion which serves as a coaster to protect any surface in which the mug comes in contact. In such embodiments, the coaster portion covers at least a portion of the bottom portion of the mug. In one embodiment, at least about ten (10)% of the bottom surface is covered. In one embodiment, more than ten (10)% of the bottom surface is covered, up to 20%, 30%, 40% or 50%, such as about ten (10) to 50%. In one embodiment, more than 50%, up to 60%, 70% or 80% is covered, such as about 50 to 70%. In one embodiment, more than 80% is covered, up to 90% or more, such as about 70 to 90%, up to 100% coverage of the bottom portion of the mug 104.

Figure 4A:
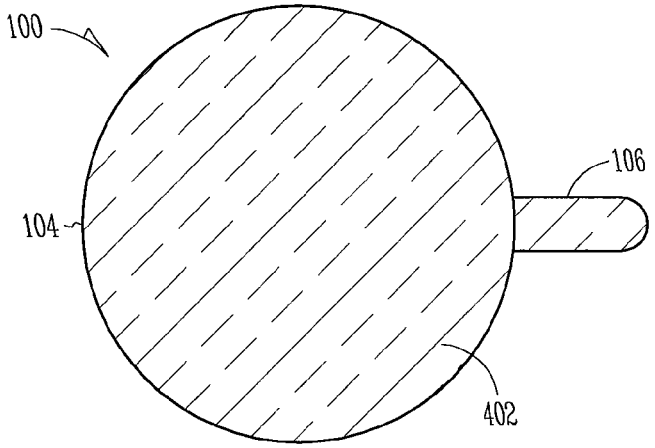
FIG. 4A is a bottom view of a mug showing a coaster portion of the reusable mug cover in FIG. 1 in an exemplary embodiment.

FIG. 4A is a bottom view of a mug 104 showing an exemplary coaster portion 402 of the reusable mug cover 100 in FIG. 1. Such a coaster portion 402 may also be present in other embodiments, such as the embodiment shown in the various figures herein. In this embodiment, the coaster portion 402 covers essentially all of the bottom portion of the mug 104. In such embodiments, the reusable mug cover 100 may be applied to the mug 104 from the bottom up, similar to a sock being placed on a foot. In one embodiment, the reusable mug cover 100 is adjusted to or is designed to not cover any of the bottom portion of the mug 104.

Figure 4B:
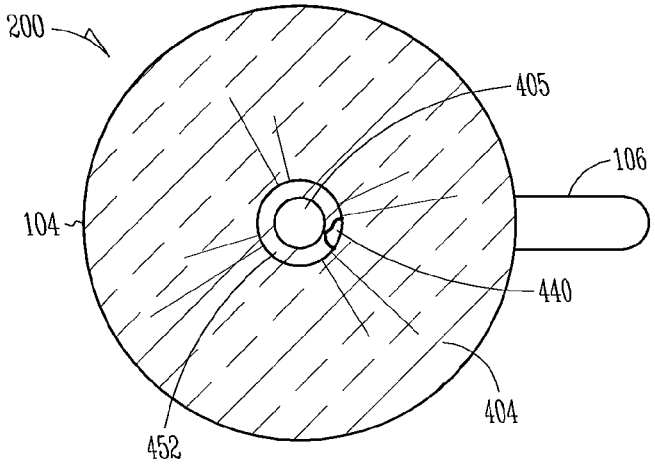
FIG. 4B is a bottom view of a mug showing an alternative coaster portion of the reusable mug cover in FIG. 2 in an exemplary embodiment.

FIG. 4B is a bottom view of a mug 104 showing an exemplary alternative coaster portion 404 of the reusable mug cover 200 of FIG. 2. In this embodiment, most of the bottom portion of the mug 104 is covered, leaving only a small opening 405 as shown. In one embodiment, the size of the small opening 405 is adjustable with use of any suitable type of separate conforming component, such as any type of elasticized material 440, which may be contained in a suitable casing 442 as shown.

Figure 4C:
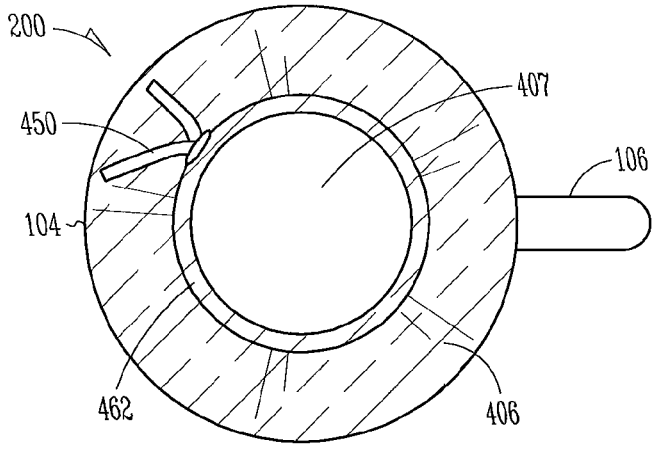
FIG. 4C is a bottom view of a mug showing another alternative coaster portion of the reusable mug cover in FIG. 2 in an exemplary embodiment.

FIG. 4C is a bottom view of a mug 104 showing another exemplary alternative coaster portion 406 of the reusable mug cover 200 of FIG. 2. In this embodiment, a smaller portion of the bottom portion of the mug 104 is covered, leaving a large opening 407 as shown. The size of the large opening 407 is adjustable with use of any suitable type of separate conforming component, such as a tie 450, as shown, which may be contained in a suitable casing 452, as shown.

Embodiments further comprise methods of making a reusable mug cover. In one embodiment, a plurality of reusable mug covers are made from a single piece of reusable cloth formed from fibers as is known in the art, and separated with any suitable separating device known in the art. In one embodiment, the reusable mug cover is formed using procedures similar to those used in the art for forming stretchable socks, which, in one embodiment, may be with no seams.

The reusable cloth may be of any suitable dimensions. In one embodiment, the reusable cloth is substantially square or rectangular. In some embodiments in which no slits or cutouts are utilized, suitably sized individual reusable mug covers are cut from the reusable cloth and joined together in any suitable manner without further modification. In other embodiments, additional closing and/or separate conforming components may be added.

Figure 5:
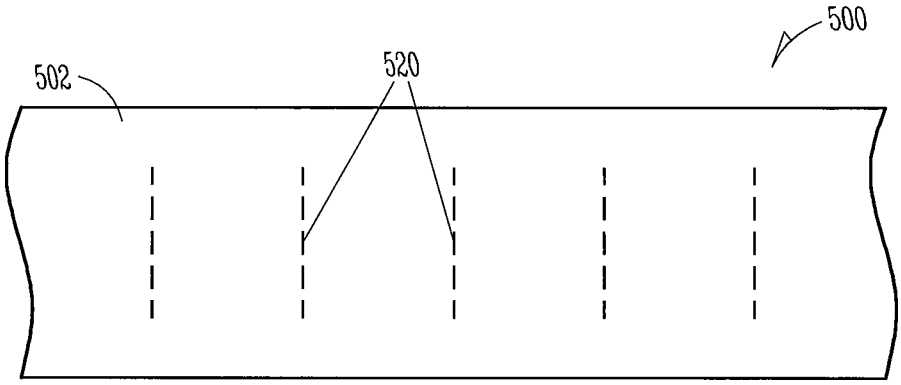
FIG. 5 is a plan view of a plurality of reusable mug covers with slits during manufacturing prior to being disconnected from one another in an exemplary embodiment.

In one embodiment, slits or cutouts are cut at suitable intervals as shown in FIG. 5. Each reusable mug cover may then be separated using any suitable separating device. FIG. 5 is an exemplary plan view 500 of a plurality of reusable mug covers during manufacturing prior to being disconnected from one another. In this embodiment, slits 520 have been cut into the reusable cloth 502 at predetermined intervals, as shown, such that no cloth as been removed.

Figure 6A:
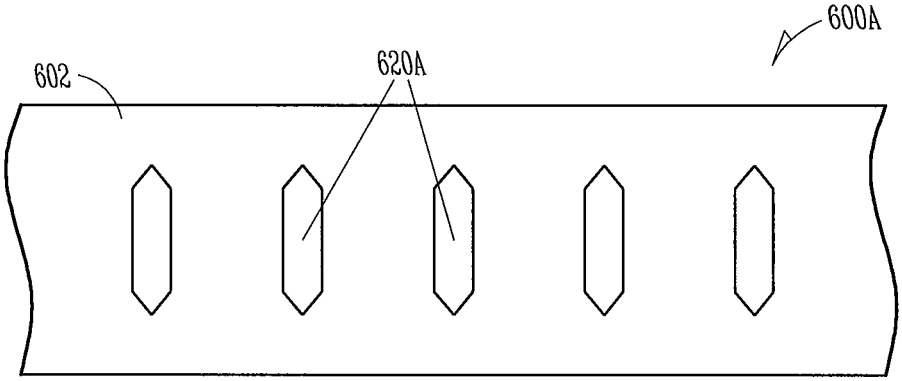
FIG. 6A is an alternative plan view of a plurality of reusable mug covers with cutouts during manufacturing prior to being disconnected from one another in an exemplary embodiment.
Figure 6B:
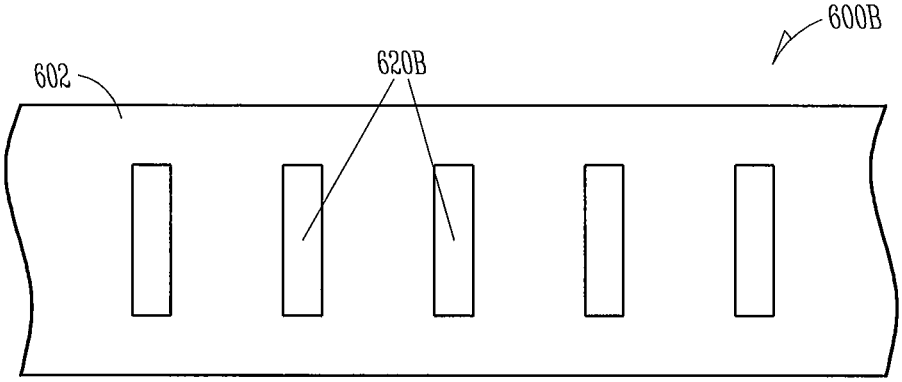
FIG. 6B is an alternative plan view of a plurality of reusable mug covers with alternative cutouts during manufacturing prior to being disconnected from one another in an exemplary embodiment.

FIGS. 6A and 6B are exemplary alternative plan views, 600A and 600B, respectively, of a plurality of reusable mug covers during manufacturing prior to being disconnected from one another. FIG. 6A shows exemplary cutouts 620A in the reusable cloth 602 having a shape comparable to the shape shown in FIG. 3B. FIG. 6B shows exemplary cutouts 620B in the reusable cloth 602 having a substantially rectangular shape. In other embodiments, any suitable shape may be utilized. Any suitable amount of fabric may be removed to form the cutouts, such as 620A and 620B, as discussed above.

In yet other embodiments, the reusable mug cover is comprised of separate pieces of reusable cloth, such as a substantially rectangular or squared-shaped portion and a circular portion, joined together at the edges.

The edges of the separated reusable cloth or separate pieces of reusable cloth may be joined together in any suitable manner to form a reusable mug cover. In one embodiment, a cylindrically shape reusable mug cover is formed. In one embodiment, the cylindrically-shaped reusable mug cover is closed on one end. Such a configuration is possible from a single piece of cloth. Such a configuration is also possible from multiple pieces of reusable cloth joined together, such as a substantially rectangular or square portion and a substantially circular portion.

In one embodiment, the edges are joined together permanently. Such an embodiment may be used for reusable mug covers that are elasticized and thus able to conform to the shape of a variety of mug sizes without any separate conforming components. The permanent securing components may comprise any of a variety of permanent securing or connecting components known in the art. In one embodiment, stitches are used to hold the edges together. In other embodiments, edges may be joined by any suitable type of adhesive, such as permanent glue, adhesive, tape, and the like.

In yet other embodiments, edges of the separated reusable cloth or separate pieces of reusable cloth may be joined together using any suitable type of temporary securing or closing components, including, but not limited to, any combination of fasteners such as zippers, snaps, buttons, hooks, hook and loop fasteners, ties, and the like. Some or all of the fasteners may be decorative in nature. Such securing or closing components may be used, for example, if the material is not sufficiently elasticized.

Figure 7:
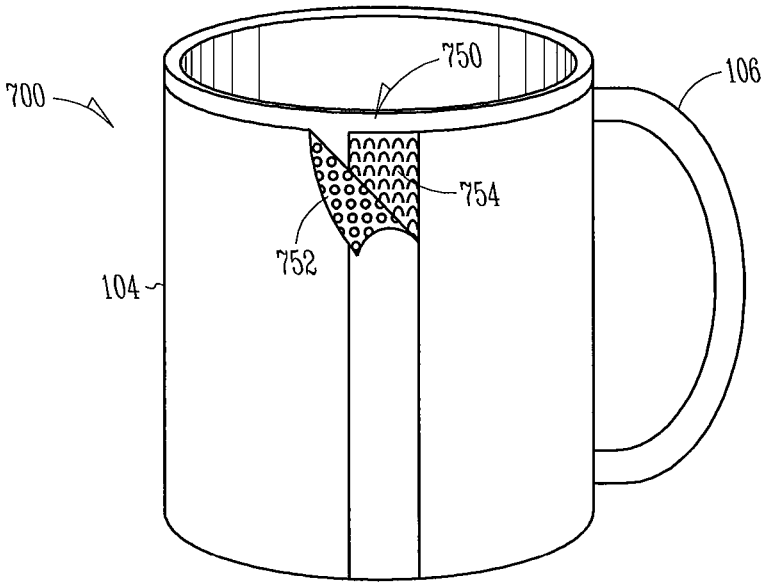
FIG. 7 is a simplified side view of a reusable mug cover having a closing component in an exemplary embodiment.

One example of a temporary securing component is shown in the reusable mug cover 700 in FIG. 7. As shown in FIG. 7, the reusable mug cover 700 in this exemplary embodiment includes a hook and loop fastener 750 having a looping surface 752 and a hooking surface 754. The hook and loop fastener 750 is shown prior to being completely joined. However, once the loop surface 752 and hooking surface 754 are connected, a continuous surface is formed around the mug 104. In this embodiment, either an expandable slit or cutout (not shown) has been provided through which the handle 106 protrudes.

Figure 8:
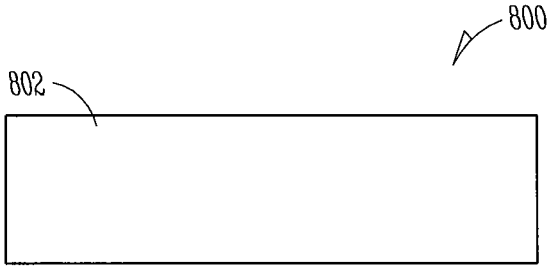
FIG. 8 is a plan view of a reusable mug cover in an exemplary embodiment.

FIG. 8 is an exemplary plan view 800 of a reusable mug cover in an embodiment. In this embodiment, the reusable mug cover has a substantially rectangular shape. The shorter sides may be joined together using any suitable permanent or temporary closing component as discussed above. Additional modifications to the reusable mug cover are possible, including creating slits or cutouts in the reusable cloth 802 through which a handle may protrude. If desired, one or both of the longer sides may be turned under and stitched, so as to create a finished edge.

Figure 9:
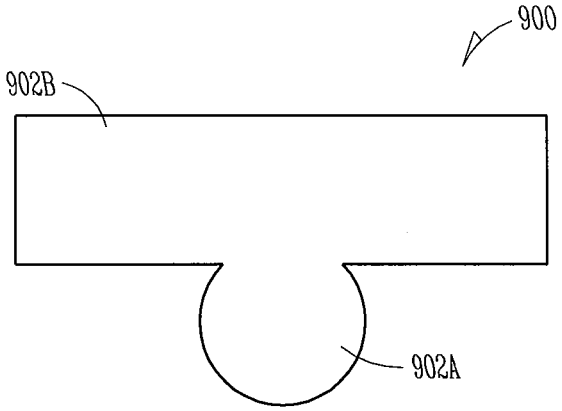
FIG. 9 is an alternative plan view of a reusable mug cover in an exemplary embodiment.

FIG. 9 is an exemplary alternative plan view 900 of a reusable mug cover in an embodiment. In this embodiment, a substantially circular bottom portion 902A is contiguous with a substantially rectangular portion 902B as shown. The various edges may be joined in any suitable manner as discussed herein. In yet other embodiments, separate pieces of reusable cloths, such as substantially rectangular and circular shaped reusable cloths, are used to form a reusable mug cover.

The resulting reusable mug cover (e.g., 100) may be slipped onto a mug from top to bottom or bottom to top, or wrapped around a mug, depending on the final shape, type of fibers in the reusable cloth, presence of closing components and/or separate conforming components, and so forth. For reusable mug covers having an opening, such as an expandable slit or a cutout, the handle may be positioned in the opening so that the mug handle may be easily grasped. If separate conforming components are present, the user may further tighten or cinch the reusable mug cover around the mug for a secure fit. (See, for example, FIGS. 4B, 4C and 7). In one embodiment, the user may optionally choose to create a coaster, a gap, or both, by adjusting or stretching the reusable mug cover up and/or down as desired. By orienting the reusable mug cover to create a suitable gap, the user's lower lip is not in contact or only has minimal contact with an upper edge of the reusable mug cover.

In most embodiments, the desired food product is added after the reusable mug cover (e.g., 100, 200, and so forth) is in place, although the invention is not so limited. In one embodiment, the reusable mug cover and food product, such as a liquid food product, contained within the mug is placed in a microwave for a suitable amount of time. In another embodiment, a food product, such as hot liquid, is added to the mug from another container, such as a tea kettle, thermos, and the like. The user may then reuse the reusable mug cover as often as desired. The user may remove the reusable mug cover to wash in any desired manner, including in the washing machine, dishwasher, and so forth. In one embodiment, the reusable mug cover remains on the mug when washed, such as when placed in the dishwasher for cleaning.

Figure 10:
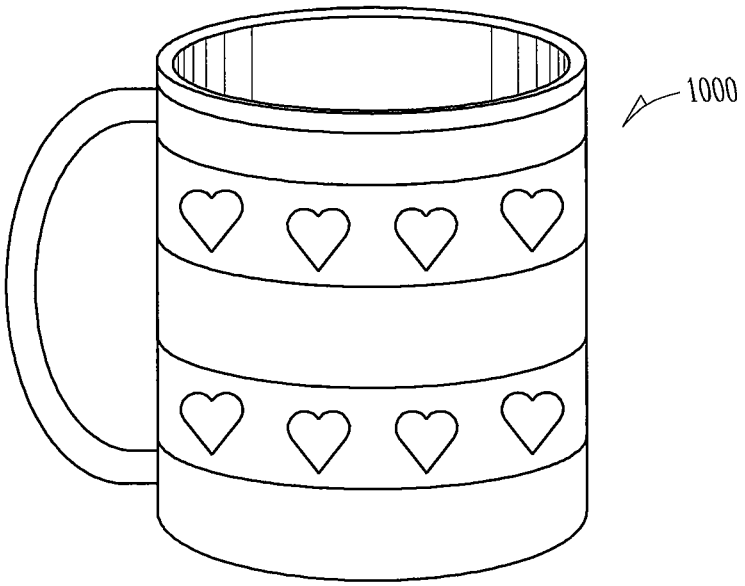
FIG. 10 is a simplified front view of a mug with an exemplary customized reusable mug cover in place in an exemplary embodiment.
Figure 11:
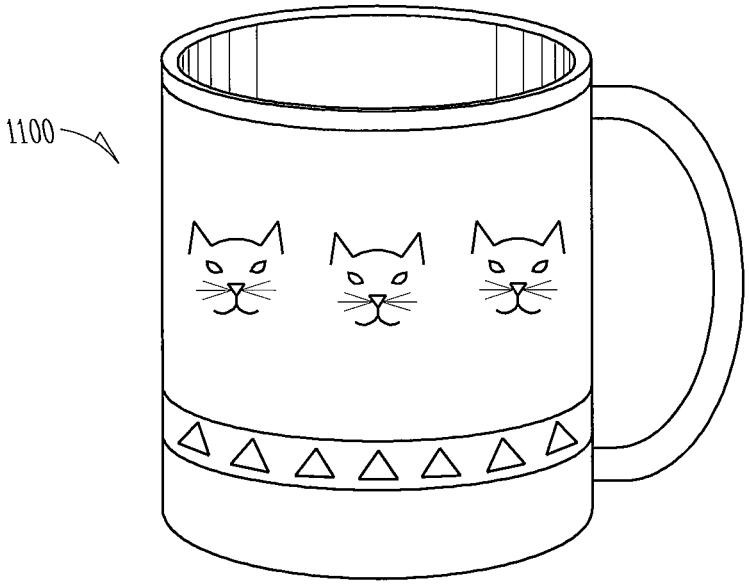
FIG. 11 is a simplified front view of a mug with an alternative exemplary customized reusable mug cover in place in an exemplary embodiment.
Figure 12:
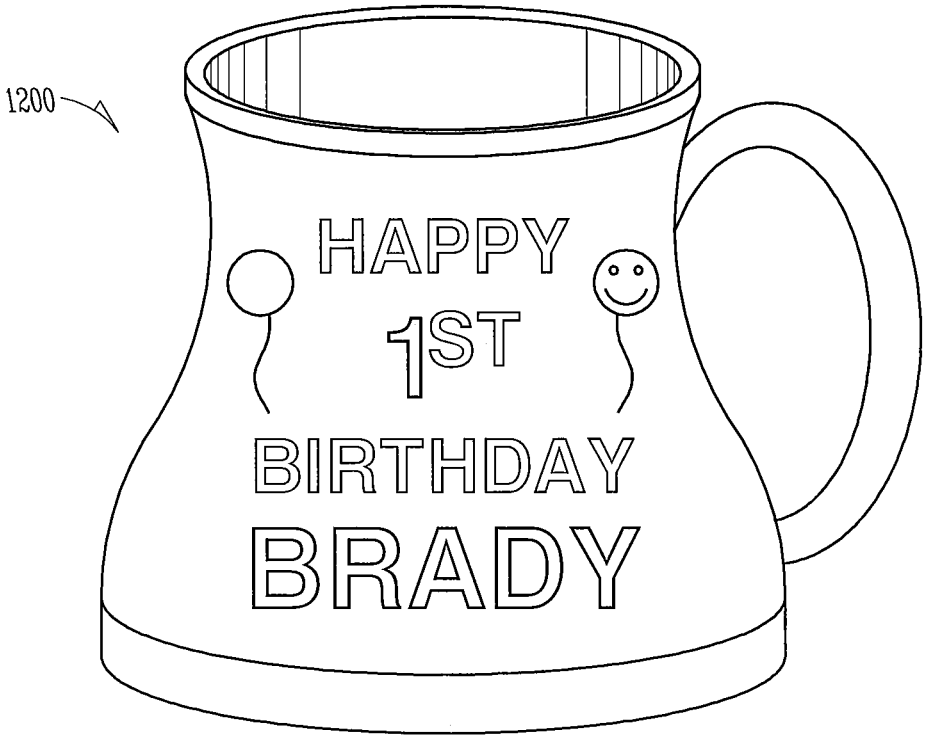
FIG. 12 is a simplified front view of a mug with another alternative exemplary customized reusable mug cover in place in an exemplary embodiment.

The reusable mug cover (e.g., 100, 200, and so forth) may be any color or colors, and may further be personalized or customized for any user and/or any occasion. For example, a child's reusable mug cover may contain colorful images, characters and/or designs which may include any type or combination of simple or complex shape. Images and designs related to birthdays, anniversaries, holidays, and so forth may also be used. See, for example, the exemplary reusable mug cover 1000 shown in FIG. 10 which includes two series of hearts, and the exemplary reusable mug cover 1100 in FIG. 11, which includes a series of cat faces, together with other exemplary designs. The exemplary reusable mug cover 1200 shown in FIG. 12 shows a design customized for a particular child's first birthday. Any number of regular or irregular designs, images and shapes may be used. In one embodiment, the designs are an add-on to the reusable cloth used as the reusable mug cover, such as with appliqué. In other embodiments, a design may be embossed into or embroidered onto the reusable cloth.

In one embodiment, a kit containing one or more reusable mug covers and one or more mugs is disclosed. In one embodiment, the kit further contains one or more dried food products, such as soups, coffees, teas, and/or cocoas, and the like. In one embodiment, the kit further comprises solid food products, semi-solid food products, liquid food products or semi-liquid food products (including concentrates), or combinations thereof, various dining paraphernalia, including spoons, spoon rests, matching napkins, placemats, kitchen dishcloths, towels, and so forth, and/or various reading materials and/or related articles.

In one embodiment, the kit is customized or personalized for a particular user such as with a name, greeting, and/or date, and so forth. In one embodiment, one or more articles in the kit, including the one or more reusable mug covers, are customized for a particular geographic location, event (e.g., space launch, athletic event), sports team, and the like, to include reading material, such as books, leaflets, brochures, and the like.

In one embodiment, the method comprises providing a reusable mug cover for use on a mug having a bottom, the reusable mug cover capable of covering at least a portion of the bottom of the mug; and reducing a rate of temperature change of a food product contained in the mug. In one embodiment, the method further includes offering for sale, advertising and/or distributing the reusable mug cover in any well-known manner, including web-based platforms and in-store arrangements. Distribution methods may include, but are not limited to, utilizing existing commercial delivery services, providing products on existing store shelves, and so forth.

Embodiments will be further described by reference to the following examples, which are offered to further illustrate various embodiments. It should be understood, however, that many variations and modifications may be made while remaining within the scope of the embodiments described herein.

Example 1

Starting Materials

Three conventional ceramic mugs purchased in the United States within the past 20 years, each having a height of about 3.75 inches, inside diameter of about 2.875 inches and a thickness of about 0.125 inches were used. Commercial women's socks purchased at local retailers in Ames, Iowa, were used as the mug covers in these experiments. The top edge of each sock was drawn substantially even with the top edge of the mug. The mug itself rested on the excess foot portion of the sock.

Mug #1 was used as a control with no added mug cover. Mug #2 was surrounded on its sides and on the bottom with the ankle portion of an Xhilaration® brand women's sock (light pink) style CLI6779H (hereinafter "XHILARATION sock"), which is a Target Brands, Inc. sock, distributed by Target Corporation, having offices in Minneapolis, Minn. The XHILIRATION sock contains 73% polyester, 26% nylon and one (1) % spandex "exclusive of elastic" (presumably wt %, although this was not specified). Mug #3 had the ankle portion of a White Stag® brand women's sock (black) (hereinafter "WHITE STAG" sock) made in China for Wal-mart corporation. The WHITE STAG sock contains 98% nylon and two (2) % spandex (presumably wt %).

Ice cubes weighing about 0.5 ounces each, from a Westinghouse® brand refrigerator/freezer "Thirst Crusher Dispensing System," Model No. ED25RQ made by Westinghouse Electric Co., having offices in Monroeville, Pa., were used. The freezer was set at an average temperature setting ("B" on the dial). The ice cubes were weighed on a Pelouze™ brand postal scale (Model 780) made by Pelouze Scales, having offices in Oak Brook, Ill. At the conclusion of the experiment, the amount of liquid present in each mug was determined to be approximately ten (10) ml.

The temperature and relative humidity were measured using a La Crosse R Technology brand digital measuring device Model No. WS-9075U-2S, made by La Crosse Technology, having offices in La Crosse, Wis.

Procedure

One ice cube was placed in each cup. The air temperature throughout the experiment was approximately 70 to 72° F. and the relative humidity was approximately 49%. Measurements of the percentage of water covering the bottom surface of each mug were initially taken at five minute intervals and shown in the Table below. The time at which each ice cube melted completely was also recorded and noted below.

Measurements of the Percentage of Water Covering the Bottom Surface of Each Mug

| Minutes, seconds | Mug #1 (control) % of bottom covered with water | Mug #2 (with XHILIRATION sock) % of bottom covered with water | Mug #3 (with WHITE STAG sock) % of bottom covered with water |
|---|---|---|---|
| 0 | 0 | 0 | 0 |
| 5 | 50 | 30 | 30 |
| 10 | 80 | 40 | 40 |
| 13, 20 | 100 | | |
| 15 | — | 70 | 65 |
| 20 | | 92 | 85 |
| 25 | | 97-99 | 95 |
| 26, 30 | | 100 | |
| 28, 08 | | | 100 |

Condensation was observed on the outside of the control mug around the entire circumference of the mug. The condensation extended from near the bottom edge up about one (1) inch of the mug. No such condensation was observed on the mugs covered with a reusable mug cover.

The ice cube in mug #1 completely melted at 32 minutes, 33 seconds, in mug #2 at 38 minutes, 24 seconds and in mug #3 at 40 minutes and 45 seconds.

These results show that the reusable mug covers described herein, when placed around the outside of a container, slow the rate of temperature change of the contents therein, as compared with no mug cover, thereby effectively serving as thermal insulators. This particular testing indicates that a higher nylon content may provide greater insulating properties, since the ice cube in mug #3 melted the slowest. However, it is further noted that the sock on mug #2 was light-colored (pink), while the sock on mug #3 was dark (black). Further testing may show that color differences have an impact on insulating properties.

Example 2 (Prophetic)

Future testing may be performed to determine the precise reduction in the rate of temperature change of various warm and hot food products in various types of containers with a reusable mug cover in place, such as mugs constructed of differing materials, using a variety of mug covers made from a variety of material types, thicknesses, colors, and so forth.

CONCLUSION

As noted above, the inventor is the first to recognize a significant need in the art for a convenient and reusable beverage container cover. The reusable mug covers described herein have several advantages, including the ability to slow the rate of temperature change of food products contained within the container it surrounds. As such, the reusable mug covers are able to keep high temperature foods warmer and cold temperature foods (including frozen foods) colder longer. The reusable mug cover has the further advantage of simplicity, as it is comprised essentially of cloth, although may optionally further comprise separate closing components and/or conforming components. In some embodiments, separate securing or closing components are additionally or alternatively used to secure edges of the reusable mug cover together as discussed herein. The reusable mug cover is not only reusable repeatedly, but is also adjustable, cleanable, and, in one embodiment, microwaveable.

Although specific embodiments have been illustrated and described herein, it will be appreciated by those of ordinary skill in the art that any arrangement that is calculated to achieve the same purpose may be substituted for the specific embodiment shown. For example, although the reusable mug cover has been shown and described for mugs having handles, it is also possible to use the reusable mug cover on containers without handles, such as disposable containers. Additionally, although the reusable mug cover has been described for use with certain food products, such as hot beverages, it is also possible to use the reusable mug cover with food products at lower temperatures, including chilled beverages, such as ice cream and frozen yogurts. Use of a reusable mug cover in such applications would also provide comfort and serve to slow down the rate of temperature change of the container contents. This application is intended to cover any adaptations or variations of the present subject matter. In yet other embodiments, the reusable food product container cover is useful on various types of cookware, such as casserole dishes, and the like, and is designed to be used in any type of conventional oven. In yet other embodiments, the reusable food product container cover is useful on a variety of baby, toddler and children's products, including, but not limited to, bottles, sippy cups, conventional cups, and so forth. Therefore, it is manifestly intended that the embodiments be limited only by the claims and the equivalents thereof.

What is claimed is:

1. A mug cover comprising:

a single layer of a substantially rectangular-shaped microwavable reusable tightly woven cloth containing about 1 wt % to about 5 wt % spandex, wherein the mug cover is adapted to allow sufficient heat to radiate from heated contents contained within the mug to an outer surface of the mug cover to provide warmth to a user's hands during use, wherein the reusable cloth has an opening through which a mug handle of a mug can extend, wherein the mug has a lip, a substantially vertical outer surface, a bottom, and a handle, wherein the microwaveable reusable cloth is adapted to conform to the substantially vertical outer surface, the bottom and an area above the handle with at least one conforming component, wherein the microwaveable reusable cloth is adjustable to provide a gap around the lip and is sized to cover a sufficient portion of the bottom to function as a coaster, wherein the microwaveable reusable cloth also covers most of the substantially vertical outer surface of the mug, including the area above the handle, wherein the spandex provides the mug cover with softness, static resistance and detergent resistance, and allows the mug cover to retain an original size after being repeatedly stretched; and at least one closing component comprising at least one hook, hook and loop fastener, snap and/or button, each of which can be secured to the microwaveable reusable cloth proximate to the opening to allow the microwaveable reusable cloth to close around the mug when secured, wherein the conforming component can include the closing component.

2. The mug cover of claim 1 wherein the reusable cloth has an elastic elongation of about 10 to about 70%.

3. The mug cover of claim 1 wherein the reusable cloth further comprises fibers selected from cotton, wool, nylon, polyester, a cotton-polyester blend, and combinations thereof.

4. The mug cover of claim 1 wherein at least 50% of the bottom of the mug can be covered by the mug cover.

5. The mug cover of claim 1 wherein at least 90% of the bottom of the mug can be covered by the mug cover.

6. The mug cover of claim 1 wherein the reusable cloth has a plurality of designs.

7. The mug cover of claim 6 wherein the plurality of designs are selected from regular shapes, irregular shapes, letters, images, numbers, and combinations thereof.

8. The mug cover of claim 1 wherein the reusable cloth has at least one seam proximate to said opening.

* * * * *